US009352947B2

(12) United States Patent
Mah et al.

(10) Patent No.: US 9,352,947 B2
(45) Date of Patent: May 31, 2016

(54) ROTARY CAN OPENER

(71) Applicants: Pat Y Mah, Kowloon (CN); Alexander Joshef Kalogroulis, Surrey (GB); Kwong Keung Tung, Kowloon (CN); Michael Ng, Adelaide (AU)

(72) Inventors: Pat Y Mah, Kowloon (CN); Alexander Joshef Kalogroulis, Surrey (GB); Kwong Keung Tung, Kowloon (CN); Michael Ng, Adelaide (AU)

(73) Assignee: Daka Research Inc. (British Virgin Islands Corporation), Offshore Incorporations Centre, Road Town Tortola (VG)

( * ) Notice: Subject to any disclaimer, the term of this patent is extended or adjusted under 35 U.S.C. 154(b) by 298 days.

(21) Appl. No.: 13/974,076

(22) Filed: Aug. 23, 2013

(65) Prior Publication Data

US 2014/0101946 A1 Apr. 17, 2014

Related U.S. Application Data

(62) Division of application No. 12/807,137, filed on Aug. 27, 2010, now Pat. No. 8,539,682.

(51) Int. Cl.
*B67B 7/00* (2006.01)
*B67B 7/46* (2006.01)

(52) U.S. Cl.
CPC .. *B67B 7/385* (2013.01); *B67B 7/34* (2013.01)

(58) Field of Classification Search
CPC ..... B67B 7/32; B67B 7/34; B67B 7/385; B67B 2007/303
USPC ..... 30/400, 409, 416–418, 420–427, 429, 30/430, 401–405; 74/404, 405, 414, 436, 74/437, 63
See application file for complete search history.

(56) References Cited

U.S. PATENT DOCUMENTS

| | | | | |
|---|---|---|---|---|
| 4,365,417 | A | 12/1982 | Rosendahl | 30/422 |
| 4,574,482 | A * | 3/1986 | van der Wouden | B67B 7/34 74/436 |
| 4,833,783 | A | 5/1989 | Davel | 30/422 |
| 6,182,368 | B1 | 2/2001 | So | 30/418 |
| 6,886,260 | B1 * | 5/2005 | Lee | B67B 7/385 30/421 |
| 7,168,170 | B1 | 1/2007 | So et al. | 30/416 |
| 7,213,340 | B1 * | 5/2007 | Lee | B67B 7/385 30/416 |
| 7,437,825 | B2 * | 10/2008 | Sanders | B67B 7/34 30/417 |
| 7,574,808 | B2 * | 8/2009 | Mah | B67B 7/32 30/422 |
| 7,596,874 | B2 * | 10/2009 | Mah | B67B 7/34 30/422 |
| D634,597 | S | 3/2011 | Mah et al. | D8/41 |
| D643,269 | S | 8/2011 | Mah et al. | D8/43 |
| 8,539,682 | B2 * | 9/2013 | Mah | B67B 7/385 30/409 |
| 8,955,227 | B2 * | 2/2015 | Lee | B67B 7/385 30/427 |
| 2007/0175051 | A1 | 8/2007 | Mah et al. | 30/401 |
| 2008/0282558 | A1 | 11/2008 | So | 30/427 |

FOREIGN PATENT DOCUMENTS

| | | | |
|---|---|---|---|
| GB | 2161449 | 1/1986 | B67B 7/060 |

* cited by examiner

*Primary Examiner* — Jason Daniel Prone
(74) *Attorney, Agent, or Firm* — Curtis L. Harrington; Harrington & Harrington

(57) ABSTRACT

An easy to operate, extremely quiet, efficient can engagement and opening mechanism is provided for use in an opener for a can, and that provides a pair of missing teeth operating endpoints at opposite ends of its opener cycle, along with an eccentrically operating idler gear and cutter gear urging mechanism that produces a non-jamming foolproof mechanism that can be urged forward to a closed and operating position or reversed to a disengagement and non-operating position.

7 Claims, 9 Drawing Sheets

205
224
207
251
241
243
215
217
237
223
229
230
245
279
253
277
225
255

ROTARY CAN OPENER

This application is a divisional of U.S. patent application Ser. No. 12/807,137 filed on Aug. 20, 2010, which is now issued U.S. Pat. No. 8,539,682.

BACKGROUND OF THE INVENTION

1. Field of the Invention

The present invention relates to a mechanism for use in a can opener that uses a quiet reversal mechanism that may be provided with a manual or automated drive mechanisms.

2. Related Background Art

U.S. Pat. No. 4,365,417 issued to Rosendahl on Dec. 28, 1982 and entitled "TIN OPENER" describes a can opener that uses a missing teeth structure at one end of travel of a cutter gear. The open position of the cutter lies at the end of a number of teeth of the cutter movement gear. In essence, a user turns a butterfly shaped actuator from a first, resting stopped position and in a direction of engagement that causes the cutter blade to move toward and engage the body of a can. At the point in which the cutter and the can, urged by a drive wheel, are closest, the drive gear encounters a "missing teeth" section of the cutter gear so that the drive gear can continue to turn the drive wheel and without having the cutter gear interfered with by the cutter gear's having stopped at the point where the cutter and the can are closest. The cutter engagement gear can be reversed to move the cutter wheel away from the drive wheel. The mechanism to assist this reversal is the use of a projection that extends outward towards a cover and is arranged to co-operate with a rubber cylinder situated within a circular ridge and an adjacent ridge and is intended to import a rotary movement to the tooth segment device. In essence, when the concave surface (missing teeth) is centrally opposite a pinion, the rotary movement tends to turn the tooth segment device (cutter gear) in such a way as to cause the teeth in the row of teeth (adjacent the section of missing teeth) to re-engage and cause the cutter gear to move the cutter away from the drive wheel.

The mechanisms to cause gear re-engagement from a position in which a drive gear opposes the "missing teeth" portion of another gear are many. Most involve a more complex method of re-starting the drive gear against the driven gear by detecting the reverse motion of the drive gear. In some designs a starter "clicking gear" is used to continually present the beginning gear of the reversal to the drive gear. Friction of an idler gear with respect to a driven gear can sometime be counted upon to get the driven gear going in a direction away from the "missing teeth" section of the driven gear. However both of these methods can greatly suffer. First, any "clicking" mechanism operates through continued wear and distracting noise. Second, the use of friction among gears in a highly lubricated environment can result in long terms changes in the ability of the driven gear to reverse. If a can opener becomes un-disengageable from a can or lid, the can opener becomes disposable or in the alternative a significant repair job is needed to free the can lid or can from the mechanism.

In the case of the Rosendahl device directly, there are several shortcomings that it has in terms of building a can opener that is utilizable in the safest and most secure way by the greatest number of people. The Rosendahl device has a butterfly drive handle which is a pair of oppositely oriented extensions that are each about one to two inches from the rotational center. The operation of the Rosendahl device requires significant dexterity, finger and thumb strength and wrist flexibility. Further, the use of a butterfly actuator involves a series of partial turns interrupted by stopping and thence further partial turns. High dexterity and strength is required. A further undesired by-product of this method of operation is the necessity to grasp the opener with one hand, periodically operate the opener with the other hand, while putting some downward pressure on the can with both hands in order to stabilize the food contents during the opening activity. To prevent spillage, the user orients the opener and the can on a flat surface and operates it in an awkward position sacrificing user comfort in exchange for a necessity to use the table as a stabilizing reference point. A user would not normally think of supporting the can to be opened with the hand supporting the bulk of the opener as the motion would be too much of a jerking motion that would cause a mess. This is because the manual force necessary to open the can is significant, as well as periodically occurring.

The Rosendahl device generally must be made of a metallic construction. One end of the toothed gear set on the cutter wheel movement gear is made up of a blocking tooth. Once the user reaches the non-operating end of the tooth segment device (toothed gear set on the cutter wheel movement gear) it cannot be rotated further by means of its pinion drive gear. Only a metal construction would have the force of hold against a user "trying" to continue movement of the pinion gear in the opposite direction. In essence one of the stronger failure modes of the Rosendahl devices occurs at the non-working end of its operational range. In a good can opener, the maximum forces should be put to work forming a nip in the can or in opening the can, not in providing strength at a non-operating end point of the opening cycle.

Another important aspect in which the Rosendahl device falls short is the requirement generally for significant strength on the part of the person opening the can. The fact that the Rosendahl device is required to be made of metal and have strength to defeat damage from turning it in the direction of the non-operating position. Requiring only enough force to make the nip and open the can might also have caused Rosendahl to have considered persons of limited strength and their need to utilize a can opener that they could operate. If the Rosendahl mechanism were optimized, then a motorized version of the design might have been practically possible. However, the single, blind ended cycle of opening would have caused Rosendahl to have included more complex stopping sensors to insure that any motorized force would not challenge the return to the non-operating position. Any motorization of this type of end point can set the mechanics of motorization against the mechanics of operation and create destruction of both. Put another way, the simple provision of the mechanism of Rosendahl into a heavy motorized housing would either have created a significant cost in sensors, electronics to precisely control the cycle, or might have ended with the motorization gearing and the operational gearing destructively fighting with each other.

What is therefore needed is a mechanism that can provide a mechanically advantaged engagement of the cutter wheel toward the can to form the nip, followed by continuous operation until the can is open. A needed can opener of this type, in order to be available in large quantity at an inexpensive price in order to facilitate its purchase as a perfunctory and useful item, should be amenable to an inexpensive construction while having a long lasting high quality mechanism. The mechanism should not make any discernible noise and should operate consistently regardless of the amount of lubrication within the gear mechanism. Most importantly, a needed can opener mechanism should facilitate use of a can opener into which it is placed by providing ease of manual operation in the case of a manual opener, and low energy consumption/long battery service in the case when the needed can opener mechanism is motorized.

SUMMARY OF THE INVENTION

A mechanism is provided for use in an opener for a can, that provides a pair of missing teeth operating endpoints at opposite ends of its opener cycle, along with an eccentrically operating idler gear and cutter gear urging mechanism that produces an easy to operate, extremely quiet, efficient can engagement an opening mechanism. The opener is actuated to a closed and operating position by turning the main drive in a first direction and then actuated to an open and disengaged position by simple reversal caused by turning the main drive in a second direction opposite from the first direction. This eliminates jamming or a "hard stop" that is seen in many openers, while simultaneously eliminating the need for a locking lever or other holding or freeing mechanism.

These and other advantages are achieved while using a few number of simple parts, and an idler gear that has an internal diameter that is oversized with respect to an eccentric boss about which it operates, and a including a cutter movement gear that has an actuator cover with a tooth engaging bump for engaging the idler gear when the idler gear shifts its position about the eccentric boss upon change in its direction.

A combination drive shaft-drive gear-drive wheel operates adjacent to the cutter movement gear and idler gear. The drive gear of the drive shaft has three stable modes of operation with respect to the cutter movement gear, including a non-engagement non-operational position when the drive shaft is being turned in a direction to disengage the cutter wheel, an engagement and operational position when the drive shaft is being turned in a direction to engage the cutter wheel, and a non-engagement but can cutting operational position when the drive shaft is being turned in a direction to and beyond engagement with cutter wheel movement gear and is not engaged with the cutter wheel movement gear but where the drive wheel is engaged in turning and cutting the can being opened.

The two ended, non-jamming or stopped mechanism allows greater freedom and advantage in both manual and electrically powered can openers. Both electrically and manually driven openers benefit from less expensive parts that would be needed to oppose the stop forces in non-double ended freewheeling operation. For manual can openers the smoother operation makes manual opening much easier, enabling the user to use one hand to steady the well secured can, preferably on a surface, and easily use the other hand to turn an extended crank. The use of lesser cranking force enables the user to better stable the can level as it turns on a surface. The reversal of the crank over only a few turns causes disengagement that is not a surprise spilling disengagement for the user. The pivoting crank handle can be stored with respect to the housing and thus take up minimal space, and in most cases less space than a conventional butterfly can opener. Further, the sharp potentially pinching metal structure relationship found in butterfly can openers is eliminated.

BRIEF DESCRIPTION OF THE DRAWINGS

Embodiments of the present invention will now be described with reference to the accompanying drawings in which.

DETAILED DESCRIPTION OF THE PREFERRED EMBODIMENTS

Figure 1:
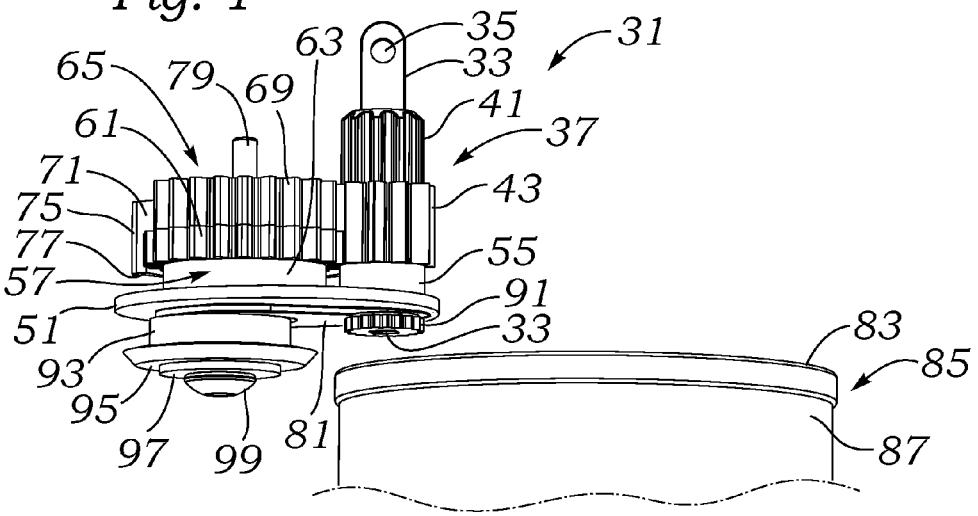
FIG. 1 is a floating perspective view of one embodiment of the invention shown for familiarity and orientation.

Referring to FIG. 1, a spatial perspective of the mechanism of the invention hereinafter referred to as rotary can opener mechanism 31 is seen as an operating assembly and without the surrounding housing details. Beginning at the top of the assembly, a drive shaft 33 is seen as having an engagement aperture 35. Drive shaft 33, for strength may preferably be made of metal. Drive shaft 33 is shown extending through an axial drive gear set 37 having an upper engagement gear 41 and a lower drive gear 43.

A number of structures that are preferably integral to a support housing are illustrated in a position isolated from the remainder of the support housing. A housing section 51 represents the base floor of a lower housing section (not shown) that would provide support for all of the connected components seen at the upper left of FIG. 1. At the right side of the housing section 51 a drive gear boss 55 is shown for rotatably supporting the drive gear 43 at a proper elevation.

At the left side of FIG. 1 and immediately above the housing section 51, an idle gear 57 having a toothed upper portion 61 and a cylindrical lower portion 63 is seen. The cylindrical lower portion 63 has a flat end (not seen in FIG. 1) that smoothly rides on an upper surface of the housing section 51 with no significant axial downward force. Although not seen in FIG. 1, the idle gear 57 has an relatively large diameter internal surface that rides loosely upon a boss (also not shown) that is eccentric and has an effective reduced diameter for portions of the boss that are located away from the closes point to the drive gear 43. This enables the idle gear 57 to move slightly with regard to a line extending through the center of the eccentric boss (not seen) each time that the idle gear 57 changes direction. When the drive gear 43 is operated, the side of the idle gear 57 feeding teeth into the teeth of the drive gear 43 tends to hug the side of the boss more tightly while the teeth fed out of the drive gear 43 tends to make a larger gap at the side of the boss (not seen). The result is an idle gear 57 that shifts its position slightly depending upon which way it is driven by the drive gear. As will be seen, this slight movement is one design element that enables the can rotary opener mechanism to operate more smoothly.

Above the idle gear 57 toothed upper portion 61 is seen the cutter movement gear 65. Cutter gear has having a toothed portion having a series of gear teeth 69. To one side of the series of gear teeth 69 is seen a concave surface or missing teeth portion 71 that is provided to enable the lower drive gear 43 to turn freely without further actuation of the cutter movement gear. To the left of the missing teeth portion 71 is seen a downwardly extending overhang member 75 that has an interior portion side 77 that opposes the toothed upper portion 61 of the idle gear 57. Since the idle gear 57 has some movement about a yet unseen boss, it is possible for the toothed upper portion 61 of the idle gear 57 to, in some limited circumstances move closer to and farther from the interior portion side 77 of the downwardly extending overhang member 75 cutter movement gear 65. Although the idle gear 57 has some lateral movement, the cutter movement gear 65 rotates evenly within the same eccentric boss (not shown) that idle gear 57 moves about with some of the aforementioned lateral freedom. A pivot axle 79 is shown protruding from the cutter movement gear 65 where the cutter movement gear 65 may derive further stability and support from an upper portion of the housing (not shown) that engages the pivot axle 79.

Beneath the housing section 51 is seen a wear plate 81 that extends from a position underneath the idle gear 57 and across to a position underneath the lower drive gear 43. The wear plate 81 is preferably made of a thin metal or highly wear resistant material, as it is subject to moving contact from an upper surface of an upper rim 83 of an upper section of can 85 and that is resting on a side wall 87. At the right side, and underneath the wear plate 81 is a drive wheel 91. Drive wheel 91 is preferably metal and metallically affixed to the drive shaft 33 and should have a diameter of about one centimeter and a number of gripping teeth which may preferably be about 18. In one embodiment, the drive shaft is pressed into the drive wheel 91 such that a small amount of the drive shaft 33 can be seen in the center of the drive wheel 91 to which the drive shaft 33 is attached. Other methods of attachment may be by welding or even integral formation of the drive shaft 33 and the drive wheel 91.

As the drive wheel 91 and drive shaft 33 are have a unitary relationship it should be noted that the drive shaft 33 and drive wheel 91 may vertically slide through and out the bottom of the upper engagement gear 41 and lower drive gear 43 were it not secured upwardly by some structure associated with engagement aperture 35. At the other side of the area underneath the housing section 51, and directly opposite the drive wheel 91 is a cutter washer 93. The cutter washer 93 will press the upper rim 83 of the can 85 against the drive wheel 91 so that the drive wheel 91 can engage the inside circumferentially inwardly directed surface of the upper rim 83 of can 85 during the cutting or can opening operation. The cutter washer 93 is generally preferably freely rotatable and facilitates rotation of the upper rim 83 of the can 85 by providing a nearly frictionless bearing surface opposing the drive wheel 91 such that the cutter washer 93 will allow the rim 83 of the can 85 to rotate as driven by the drive wheel 91.

Below the cutter washer 93 is the cutter 95, a circular sharply bevelled rotatable metal disc that rotates and cuts the side wall of the can 85 during the cutting process. A square washer 97 is seen below the cutter 95 and is so termed because it has a square aperture 99 that registers against a square member (not seen) within and below the cutter washer 93 to provide that the square washer 97 not rotate with the cutter 95. The square washer 97 is secured by a cutter screw 101. The non-rotatability of the cutter washer 93 helps to stabilize the cutter screw 101 by not subjecting the cutter screw 101 to rotational force that might otherwise cause it to disconnect from the other parts of the rotary can opener mechanism 31.

Typical drive wheels 91 have been known to be about 1.6 centimeters in diameter with about 25 gripping teeth. The small size of the drive wheel 91 has two important effects. First it enables less turning moment to advance the can. Second, it enables the drive wheel 91 and its associated gearing such as lower drive gear 43 to also be much closer to, smaller, and to take a greater mechanical advantage with respect to the force imparted to the cutter movement gear 65 and without the need for intermediate gearing. The diameter of the cutter washer 93 is about 1.7 centimeters and the diameter of the cutter 95 is about 2.3 centimeters, both sizes of a magnitude normally associated with larger 1.6 centimeter drive wheels. The ratio of the diameter of the drive wheel 91 to the cutter washer 93 is then about 1:1.7 or about 0.58. The ratio of the diameter of the drive wheel 91 to the cutter 95 is then about 1:2.3 or about 0.434.

Thus the use of a drive wheel 91 enables a greater mechanical advantage by enabling a gear directly related to the same shaft 33 to which drive wheel 91 is attached, namely the lower drive gear 43 to cause rotation of the cutter movement gear 65, as well as to provide an advantageous mechanical advantage in moving the upper rim 83 of a can to be cut. In addition, and in the open position, the spacing between the drive wheel 91 and the cutter washer 93 is about 0.7 centimeters while the diagonal opening between the drive wheel and the cutter 95 cutting edge is about 0.3 centimeters. In the closed position, the spacing between the drive wheel 91 and the cutter washer 93 is about 0.1 centimeters. The result is that the axial center of the drive wheel 91 is only about 1.45 centimeters from the axial center of the cutter 95 and cutter washer 93. This closer axial relationship enables more force with components that are either smaller or do not have to withstand greater stresses to achieve such force. The cutter washer 93 and cutter 95 only have to travel 0.6 centimeters, which is 60% of the distance of the diameter of the drive wheel 91.

Figure 2:
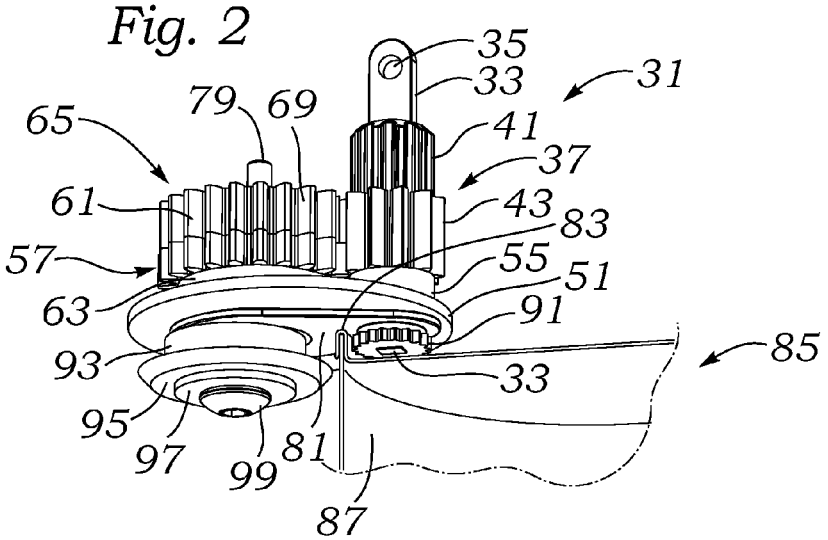
FIG. 2 is a floating perspective view of one embodiment of the invention as in FIG. 1 and shown at the point of proximity to a can.

A partial introduction into the workings of the rotary can opener mechanism 31 will be initially seen, but also repeated later, with reference to FIGS. 2 and 3. Referring to FIG. 2, and respect to the view shown, the series of gear teeth 69 of the toothed portion cutter movement gear 65 are seen while the visually observable cutter assembly components including the cutter washer 93, cutter 95, square washer 97 and the cutter screw 101 are positioned away from the drive wheel 91 sufficient for the can 85 upper rim 83 to be positioned between the visually observable cutter assembly and the drive wheel 91. As the drive shaft 33 is turned clockwise looking down into the end of the drive shaft 33 adjacent the engagement aperture 35, the series of gear teeth 69 of the cutter movement gear 65 begin to move from left to right as the cutter movement gear 65 begins to turn counterclockwise taken from view looking down onto the cutter movement gear 65. This rotates the acentrically mounted the visually observable cutter assembly components including the cutter washer 93, cutter 95 square washer 97 and the cutter screw 101 begin to rotatably displace toward the wall 87 of the can 85.

Figure 3:
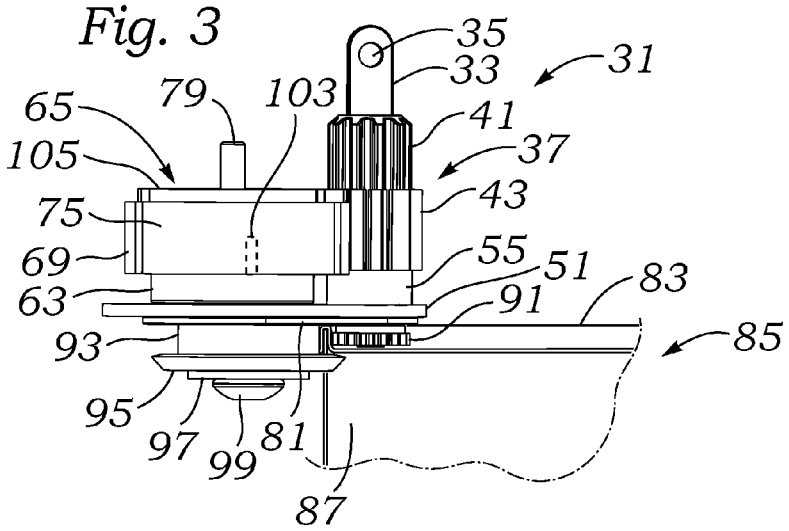
FIG. 3 is a floating perspective view of one embodiment of the invention as in FIGS. 1 and 2 and showing closed engagement with an the beginning of cutting of a can.

Referring to FIG. 3, a side view illustrates the cutter wheel 95 engagement of the wall 87 of the can 85 that is the fully engaged result of the visually observable cutter assembly components being rotatably displaced toward the wall 87 of the can 85. Note that the full extent of the downwardly extending overhang member 75 is seen and that from the angle of view of FIG. 3 that it totally obscures any view of the toothed upper portion 61 of the idle gear 57. To the right of center of the downwardly extending overhang member 75, an interference bump 103 is illustrated in dashed line format. As will be seen more fully, the interference bump 103 is a circumferentially inwardly projecting protrusion that can provide some engagement with the space between two adjacent teeth of the toothed upper portion 61 of the idle gear 57 but only if the idle gear 57 were laterally shifted toward the downwardly extending overhang member 75. Recall that downwardly extending overhang member 75 is a part of the concentrically rotatable cutter movement gear 65 and that cutter movement gear 65 cannot laterally shift. Other new details seen in FIG. 3 include an upper flattened rim 105 that can help the cutter movement gear 65 to be contained and operate with minimum friction against an inside upper wall of a housing in which the rotary can opener mechanism 31 is housed.

Figure 4:
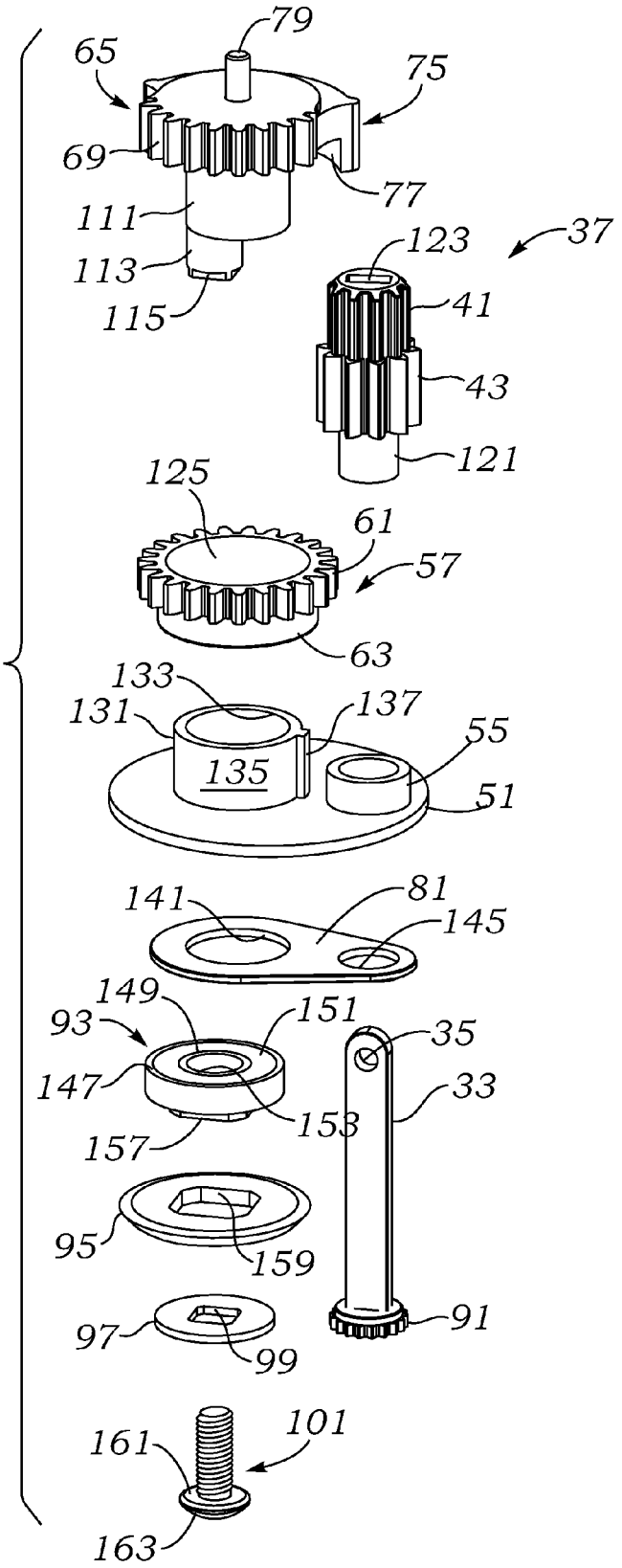
FIG. 4 is an exploded view of the components of the can opener mechanism seen in FIGS. 1-3 and illustrating further details of the components thereof.

Referring to FIG. 4, an exploded view of the components of the rotary can opener mechanism 31 reveal further details of the components seen in side view in FIGS. 1-3. At the top of FIG. 4, the cutter movement gear 65 is seen to have a central cylindrical member 111 about which the cutter movement gear 65 precisely rotates, as will be shown. Beneath the central cylindrical member 111 is a cutter support member 113 that is mounted acentrically with respect to cylindrical member 111. The acentrically mounted cutter support member 113 is used to move the cutter 95 mounted thereon closer or farther from the drive wheel 91 upon rotation of the cutter movement gear 65. At the bottom end of the acentrically mounted cutter support member 113 is a rectangular projecting member 115 for engagement with the square washer 97 to isolate any rotation from and to stabilize the cutter screw 101. Cutter screw 101 engages a bore (not shown in FIG. 4 through a center of acentrically mounted cutter support member 113.

The axial drive gear set 37 is further seen to have a lower cylindrical member 121 for interfitting and deriving stable rotational support within and from the drive gear boss 55, and an upper slot opening 123 for slidably accepting the drive shaft 33. Idle gear 57 is seen as having an internal surface 125. Below the idle gear 57, a view from a higher vantage point illustrates the housing section 51, the previously seen drive gear boss 55, and seen for the first time is the cutter movement gear boss 131 and its internal surface 133. The cutter movement gear boss 131 is seen as having an exterior cylindrical surface 135 that is interrupted by a circumferentially outwardly projecting rib 137.

The rib 137 acts to force some closeness of the idle gear 57 to the drive gear boss 55 and thus to the drive gear set 37 having an upper engagement gear 41 and a lower drive gear 43, but possibly over a narrower urging face. An alternative mechanism, such as by having an elliptical outer surface (not seen in FIG. 4) will be illustrated. Other possibilities include a thickening (not necessary elliptical) in the direction of drive gear boss 55 combined with a reduced size of the exterior cylindrical surface 135 on the lateral of a line extending away from the area between idle gear 57 to the drive gear boss 55. In yet other cases, a mere oversize of the idle gear 57 with respect to the drive gear boss 55 will be sufficient to produce the type of laterally shifting action of the idle gear 57 to be described. However the use of a circumferentially outwardly projecting rib 137 emphasizes several aspects of the use of the idle gear 57. First, an idle gear 57 has teeth that serve to place an engaging bearing load on only a portion of the axial length and narrow arc width urged by the narrow circumferentially outwardly projecting rib 137. Secondly, the shape and depth of teeth of the toothed upper portion 61 of the idle gear 57 can, with relaxation of other factors determine the lateral angular pivot displacement about the closest point of mesh of the toothed upper portion 61 of idle gear 57 even as idle gear 57 is engaged with the teeth of lower drive gear 43.

It is seen that since exterior cylindrical surface 135 has a given cylindrical diameter, that a projection such as circumferentially outwardly projecting rib 137 causes the cutter movement gear boss 131 to have an even greater effective diameter, i.e. the distance between the circumferentially outwardly projecting rib 137 to the side of the exterior cylindrical surface 135 opposite the circumferentially outwardly projecting rib 137. However, the internal surface 125 of the idle gear 57 has an internal diameter even larger than such even greater effective diameter to enable it to have sufficient looseness to enable an angular pivot displacement about the closest point of mesh of the toothed upper portion 61 of idle gear 57 with respect to the teeth of lower drive gear 43.

Below the housing section 51, the wear plate 81 can be seen as having a pair of apertures including a central cylindrical member and wear aperture 141 that admits the central cylindrical member 111 through the wear plate 81 and provides an expanded area wear and stabilization for the very abbreviated portion of central cylindrical member 111 that extends through it. In a like manner, wear plate 81 has a lower cylindrical member and wear aperture 145 that admits the lower cylindrical member 121 through the wear plate 81 and provides an expanded area wear and stabilization for the very abbreviated portion of lower cylindrical member 121 that extends through it.

Below the central cylindrical member and wear aperture 141 is located the cutter washer 93 that is seen to have a strong outer wall 147, a strong inner wall 149, separated by a channel 151, and an internal bore 153 that matches the outer diameter of the acentrically mounted cutter support member 113. The cutter washer 93 is rotatable, but includes a downward rectangular projection 157 that matches a rectangular aperture 159 seen in the cutter 95. Where the cutter 95 is thus keyed to rotate with the cutter washer 93, there is some assurance that neither the cutter washer 93 nor cutter 95 will become stuck and wear unevenly.

Below the cutter 95, the square washer 97 can be seen as having a central square aperture that is sized for engagement with the rectangular projecting member 115 of the acentrically mounted cutter support member 113. The rectangular projecting member 115 prevents rotation of the square washer 97 to prevent any exterior rotational movement of the cutter 95 from touching the cutter screw 101. Thus, the cutter screw 101, the material within the acentrically mounted cutter support member 113 with which cutter screw 101 is fastened, and the square washer 97 against which an underside 161 of a head 163 of the cutter screw 101 rests will experience no dislodgement friction from the natural turning of the cutter washer 93 and the cutter 95.

The operation of the rotary can opener mechanism 31 involves both the cutter movement gear 65 and the idle gear 57 that lies below it. Superimposing both views can lead to confusion, and therefore it can be best explained in a series of side by side views that illustrate the relationship between them. Further, each of the endpoints of travel of the cutter movement gear 65 can have two idle gear 57 positions associated with it. As a result, there are mathematically five states that the cutter movement gear 65 and the idle gear 57 can assume in their normal cycling, and those states are independent of whether the endpoints of travel of the cutter movement gear 65 has been achieved. As shown in FIGS. 1-4, the cutter movement gear 65 has a downwardly extending overhang member 75 having an interior portion side 77 that supports a circumferentially inwardly disposed interference bump 103, that may be a type of inwardly directed tooth and that is sized to provide some slight engagement with the teeth of the toothed upper portion 61 of the idle gear 57. Such slight engagement will only occur when the axial drive gear set 37 is turning in a certain direction while the cutter movement gear 65 is at one of the two ends of its cycle of travel. Engagement can happen also between endpoints but has little effect as teeth 69 and 43 are also engaged.

Figure 5:
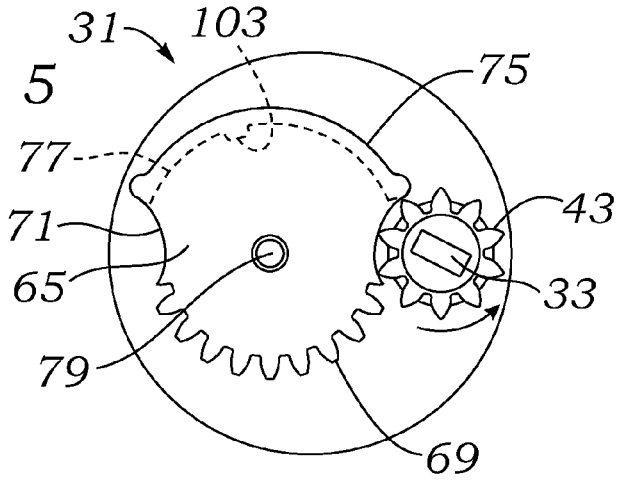
FIG. 5 is a schematic view looking down onto the rotary can opener mechanism seen in FIGS. 1-4 and at the level of the top of the cutter movement gear as a beginning of the explanation of the action of the components in explanation of a full cycle of action.

Referring to FIG. 5, a view looking schematically down onto the rotary can opener mechanism 31 as seen in FIGS. 1 and 2 is seen. Upper engagement gear 41 is omitted for clarity of illustration. Rotary can opener mechanism 31 is in an open position and ready to accept the can 85 for opening. The lower drive gear 43 on the drive shaft 33 is shown with a counterclockwise arrow to indicate that cutter movement gear 65 had just arrived at that position through a clockwise movement of the cutter movement gear 65 and that it has just stopped moving while the lower drive gear 43 might have moved for a few moments and thus the counterclockwise arrow about lower drive gear 43. The position shown would have been arrived at by having the user turn lower drive gear 43 in a direction opposite of the drive direction to create can 85 cutting, also known as toward the open position and perhaps and a little beyond what would be required to open the rotary can opener mechanism 31 as seen in FIGS. 1 and 2. The lower drive gear 43 can continue to turn in this opening or release direction so long as it faces the concave surface or missing teeth portion 71 without causing any further movement in the cutter movement gear 65.

Figure 6:
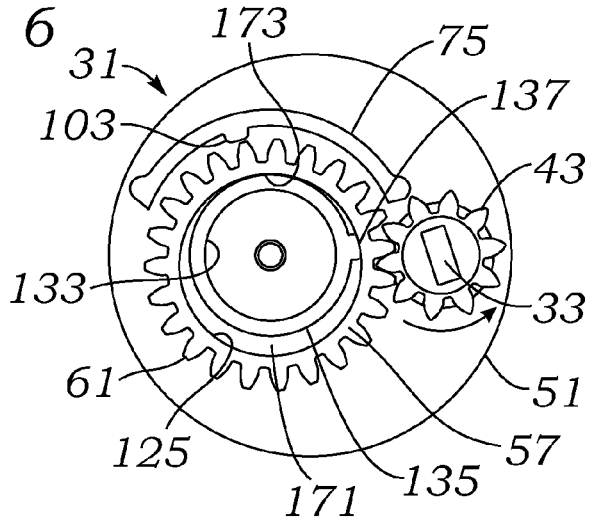
FIG. 6 is a schematic view looking down onto the rotary can opener mechanism seen in FIGS. 1-4 and at the level of the toothed upper portion of the idle gear and showing the interaction corresponding to the view of FIG. 5 and the non-interaction of the interference bump of the downwardly extending overhang member with the toothed upper portion of the idle gear.

Referring to FIG. 6, a schematic view of both the lower drive gear 43 and idle gear 57 as it appear while the lower drive gear 43 and cutter movement gear 65 are in the state shown in FIG. 5 is seen. A similar counterclockwise arrow about the lower drive gear 43 is seen as if it were in motion. Note that a gap 171 exists between the exterior cylindrical surface 135 of the cutter movement gear boss 131 and the internal surface 125 of the idle gear 57 on the side of the cutter movement gear boss 131 that is downstream of the exit feed of teeth of the toothed upper portion 61 from the mesh connection of the toothed upper portion 61 of the idle gear 57 and the lower drive gear 43 of the drive shaft 33. On the side of the cutter movement gear boss 131 exterior cylindrical surface 135 opposite the gap 171, an area of contact 173 or near contact between the exterior cylindrical surface 135 of the cutter movement gear boss 131 and the internal surface 125 of the idle gear 57 is seen. This on the side of the cutter movement gear boss 131 that is upstream of the exit feed of teeth of the toothed upper portion 61 from the mesh connection of the toothed upper portion 61 of the idle gear 57 and the lower drive gear 43 of the drive shaft 33. Put another way, an "upstream" side pulls the idle gear 57 close to the boss 131, and a "downstream" side pushes the idle gear 57 away from the boss 131.

If and when the lower drive gear 43 ceases motion, the existence and orientation of the gap 171 contact 173 is not expected to change. Of course, if the rotary can opener mechanism 31 were to attain a position such that gravity might urge the idle gear 57 to shift so that the gap 171 lessened in magnitude so that contact 173 was lost, this is a passive state of affairs and does not affect the position of the gap 171 and contact 173 used herein to explain the action of the idle gear 57. Also note that the downwardly extending overhang member 75 is on the side of the idle gear 57 having the contact 173 and opposite the side having the gap 171. So, if the lower drive gear 43 continues to turn counterclockwise with respect to the view of FIG. 6, the idle gear 57 will continue to turn such that its toothed upper portion 61 will not have contact with the interference bump 103. In real terms, a user who has turned the lower drive gear 43 to open up the rotary can opener mechanism 31 reaches a point where the drive shaft 33 simply continues to spin and the orientation of components as shown in FIG. 6 will continue. This is in marked contrast to a can opener system that relies upon the physical integrity of interfering or jamming gears to halt and withstand movement of the drive shaft 33. In essence, the rotary can opener mechanism 31 removes the possibility that a user can harm it at either end of its cycle, as will be shown.

Figure 7:
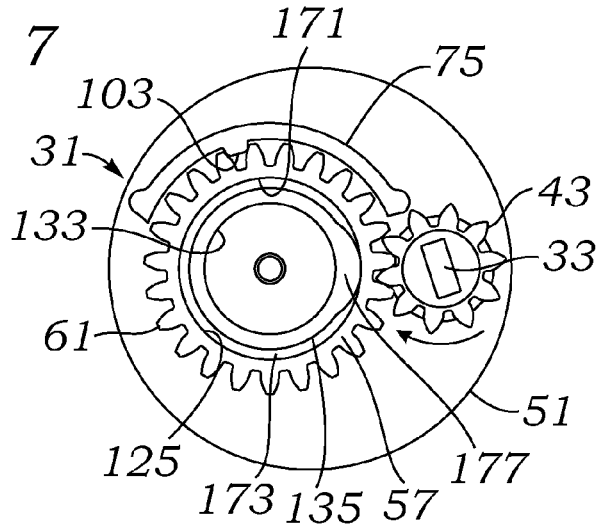
FIG. 7 is a schematic view looking down onto the rotary can opener mechanism seen in FIGS. 1-4 and at the level of the toothed upper portion of the idle gear and showing the interaction corresponding to the view of FIG. 5 but at a moment after a change in direction of the lower drive gear and illustrating contact interaction of the interference bump of the downwardly extending overhang member with the toothed upper portion of the idle gear.

FIG. 7 is a view of the rotary can opener mechanism 31 at the moment where the lower drive gear 43 just begins motion in the clockwise direction (opposite of its counterclockwise motion seen in FIG. 6). After only one tooth is displaced, the gap 171 disappears from the side of the cutter movement gear boss 131 opposite the location of the downwardly extending overhang member 75. The contact 173 breaks as the idle gear 57 shifts toward the cutter movement gear 65 downwardly extending overhang member 75, since it is this side of idle gear 57 that begins to be fed into the gear mesh connection of the toothed upper portion 61 of the idle gear 57 and the lower drive gear 43 of the drive shaft 33. This movement of the idle gear 57 toward the downwardly extending overhang member 75 causes the toothed upper portion 61 of the idle gear 57 to engage the interference bump 103. This engagement is slight, especially since the interference bump 103 is not particularly deep. The only slight work that the idle gear 57 does is to urge the cutter movement gear 65 very slightly toward the teeth of the lower drive gear 43 sufficient for the lower drive gear 43 to begin to engage the series of gear teeth 69 carried by the cutter movement gear 65. A variation in the structure 137 immediately inside the idle gear 57 is seen as ellipse shaped structure 177 to show another possible variation.

Figure 8:
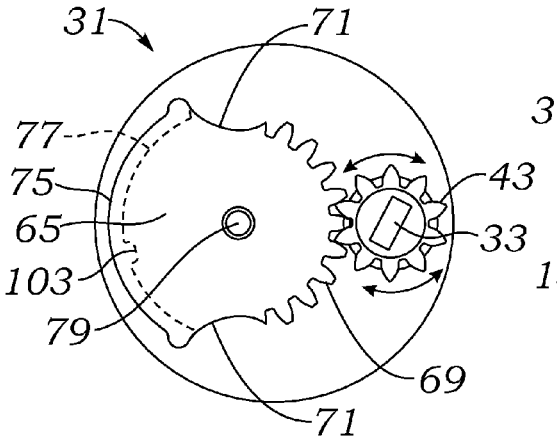
FIG. 8 is a schematic view looking down onto the rotary can opener mechanism seen in FIGS. 1-4 and at the level of the top of the cutter movement gear and where the lower drive gear is engaged with the gear teeth of the cutter movement teeth and where the cutter movement gear is mid-way through a change in position.

Once the first of the series of gear teeth 69 carried by the cutter movement gear 65 engages the lower drive gear 43, the lower drive gear 43 may continue to smoothly and quietly begin to turn the cutter movement gear 65 to cause the cutter 95 to move toward the drive wheel 91. Referring to FIG. 8, a view similar to that seen in FIG. 5 illustrates angular displacement of the cutter movement gear 65 to a position mid-way of its total travel. Upper engagement gear 43 is shown as having a two directional movement as the view shown in FIG. 8 can represent the mid point in the path from open (as seen in FIGS. 1 and 2) to closed (as seen in FIG. 3), or closed to open. During the middle portion of the path between closed and open, the lower drive gear 43 is engaged with both the idle gear 57 and gear teeth 69 of the cutter movement gear 65. The interference bump 103 may or may not ride passively within the teeth of the toothed upper portion 61 as it is not mandatory that the overall number of gear teeth in a complete circle of the toothed upper portion 61 be the same as the number of teeth that form a complete circle as to the series of gear teeth 69. However, any relative movement between the interference bump 103 and teeth of the toothed upper portion 61 will occur so slowly as to be passive and silent.

Figure 9:
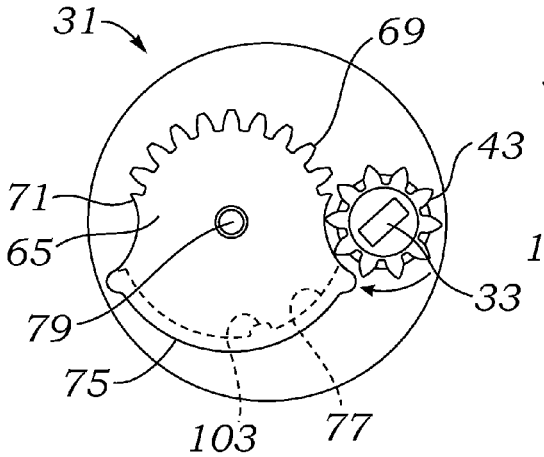
FIG. 9 is a schematic view looking down onto the rotary can opener mechanism seen in FIGS. 1-4 and at the level of the top of the cutter movement gear and where the lower drive gear opposes the other missing teeth portion of the cutter movement gear and where the lower drive gear continues to turn.

Referring to FIG. 9, a view looking schematically down onto the rotary can opener mechanism 31 as seen as in FIGS. 5 and 8. Rotary can opener mechanism 31 has just moved cutter movement gear 65 to a closed position and has already caused the cutter 95 to form a nip in the can wall 87 and further turning of the upper engagement gear in the clockwise direction will cause the drive wheel 91 to cause the rim 83 of the can to be fed between it and the cutter washer 93 to perform the can 85 cutting process. As was the case for FIG. 5, the lower drive gear 43 can continue to turn so long as it faces the concave surface or missing teeth portion 71 without causing any movement in the cutter movement gear 65.

Figure 10:
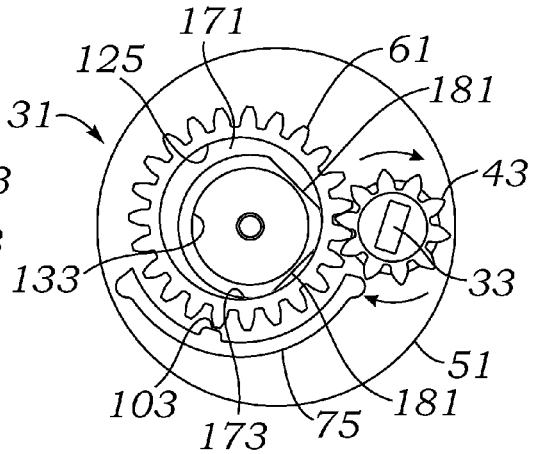
FIG. 10 is a schematic view looking down onto the rotary can opener mechanism seen in FIGS. 1-4 and at the level of the toothed upper portion of the idle gear and showing the interaction corresponding to the view of FIG. 9 and illustrating non-interfering non-contact interaction of the interference bump of the downwardly extending overhang member with the toothed upper portion of the idle gear.

As the cutting operation continues, and referring to FIG. 10 a gap 171 will exist between the exterior cylindrical surface 135 of the cutter movement gear boss 131 and the internal surface 125 of the idle gear 57 on the side of the cutter movement gear boss 131 that is downstream of the exit feed of teeth of the toothed upper portion 61 from the mesh connection of the toothed upper portion 61 of the idle gear 57 and the lower drive gear 43 of the drive shaft 33. The gap 171 is seen to occurs on the side of the gear boss 131 opposite the side where the downwardly extending overhang member 75 is located and thus interference bump 103 is not contacted and is unaffected. On the side of the cutter movement gear boss 131 exterior cylindrical surface 135 opposite the gap 171, an area of contact 173 or near contact between the exterior cylindrical surface 135 of the cutter movement gear boss 131 and the internal surface 125 of the idle gear 57 is seen. This on the side of the cutter movement gear boss 131 that is upstream of the exit feed of teeth of the toothed upper portion 61 from the mesh connection of the toothed upper portion 61 of the idle gear 57 and the lower drive gear 43 of the drive shaft 33. The contact 173 is on the same side of the boss 131 as the downwardly extending overhang member 75. The orientation seen in FIG. 10 continues for so long as the can 85 opening operation continues. If and when the lower drive gear 43 ceases motion, such as when the can cutting operation is completed, and the upper rim 83 is separated from the can wall 87, a reversal of the direction of turn of the drive shaft 33 and lower drive gear 43 would start the opening process whereby the drive wheel 91 and cutter washer 93-cutter 95 would move away from each other to release the can 85 rim 83. A further variation on the shape of the cutter movement gear boss 131 involves elimination of the circumferentially outwardly projecting rib 137 with optional removal of material at the sides of the cutter movement gear boss 131 indicated by removal areas 181. Any number of other tolerances, structures, and other accommodations can allow the idle gear 57 to shift itself into contact with the interference bump 103, including its own flexibility.

Figure 11:
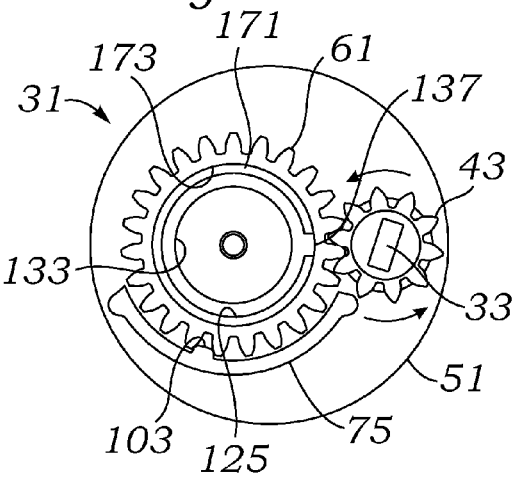
FIG. 11 is a schematic view looking down onto the rotary can opener mechanism seen in FIGS. 1-4 and at the level of the toothed upper portion of the idle gear and showing the interaction corresponding to the view of FIG. 9 but at a moment after a change in direction of the lower drive gear and illustrating a re-contact interaction of the interference bump of the downwardly extending overhang member with the toothed upper portion of the idle gear which will enable the cutter movement gear to begin to reverse its direction.

Referring to FIG. 11, the moment that the lower drive gear 43 begins to turn in the counterclockwise direction, and perhaps after only one tooth is displaced, the gap 171 disappears from the side of the cutter movement gear boss 131 opposite the location of the downwardly extending overhang member 75. The contact 173 breaks as the idle gear 57 shifts toward the cutter movement gear 65 downwardly extending overhang member 75, since it is this side of idle gear 57 that begins to be fed into the gear mesh connection of the toothed upper portion 61 of the idle gear 57 and the lower drive gear 43 of the drive shaft 33. This movement of the idle gear 57 toward the downwardly extending overhang member 75 causes the toothed upper portion 61 of the idle gear 57 to engage the interference bump 103. The engagement is again slight, as before. Once again, the only slight work that the idle gear 57 does is to urge the cutter movement gear 65 very slightly toward the teeth of the lower drive gear 43 sufficient for the lower drive gear 43 to begin to engage the series of gear teeth 69 carried by the cutter movement gear 65, but with the cutter movement gear 65 now turning in the opposite direction.

Once the first of the series of gear teeth 69 carried by the cutter movement gear 65 again engage the lower drive gear 43, the lower drive gear 43 may continue to smoothly and quietly begin to turn the cutter movement gear 65 to cause the cutter 95 to begin to move away from the drive wheel 91. This continues until the lower drive gear 43 are at a midway point with respect to the series of gear teeth 69 of the cutter movement gear 65. Further movement of the lower drive gear 43 will cause the cycle to arrive at the stage that was explained with respect to FIG. 5. Then, the lower drive gear 43 can continue to be turned in the open position as seen in FIGS. 5 and 6, or it can be reversed to re start the cycle as was described beginning with the description given for FIG. 7.

Figure 12:
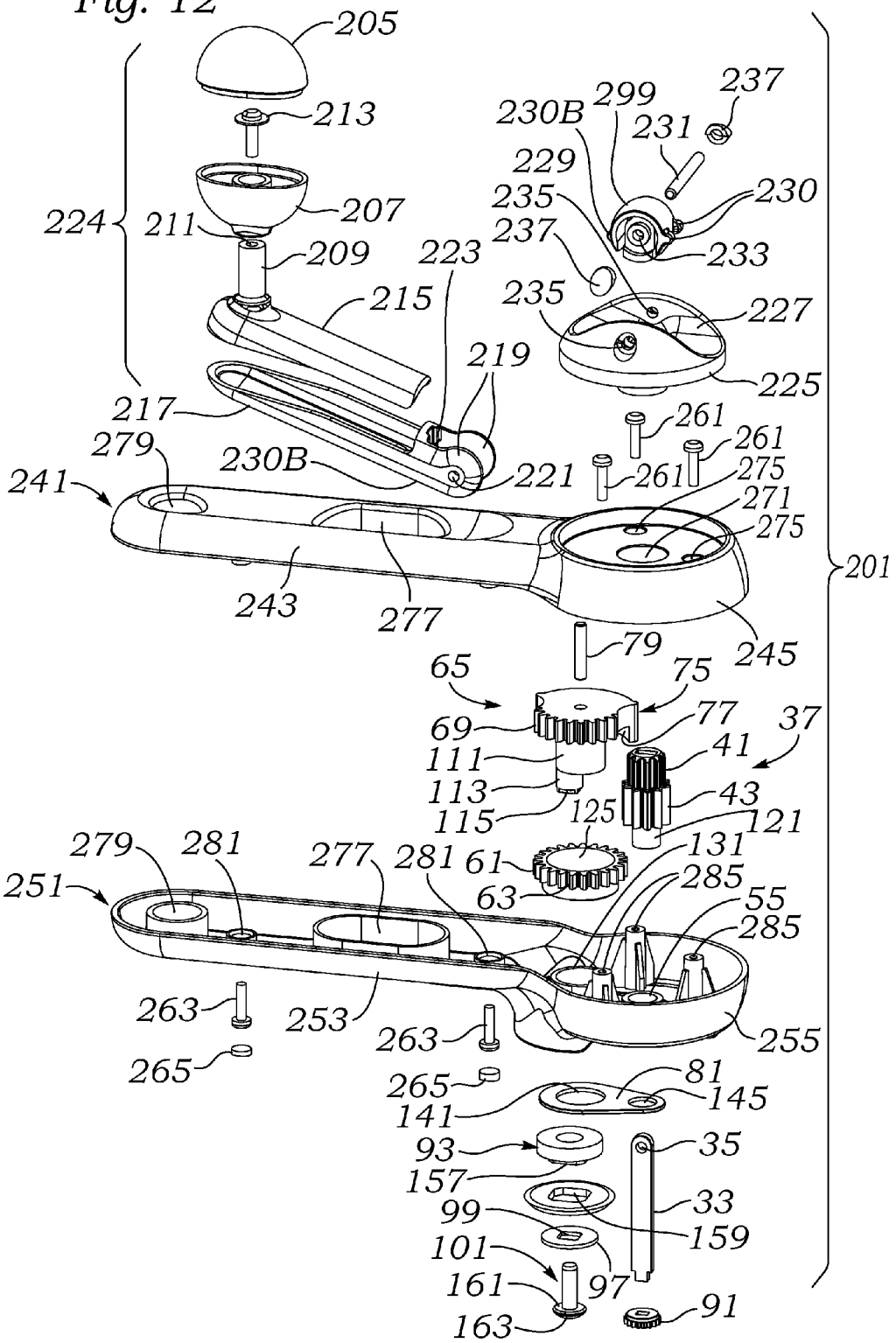
FIG. 12 illustrates an exploded view of one realization of a manual rotary can opener that utilizes the rotary can opener mechanism seen in FIGS. 1-11.

Referring to FIG. 12, an exploded view of one realization of a manual rotary can opener 201 that utilizes the rotary can opener mechanism 31 seen in FIGS. 1-11 is shown. The manual rotary can opener 201 is designed with several objectives in mind, including (1) ease of storage and deployment, (2) stability during can opening operation to reduce spills and the like, and (3) ease of operation during opening so that even a person of limited physical capability can more easily use can opener 201. The Exploded view not only facilitates the identification of both old and new component parts, it emphasizes the simplicity and modularity of parts necessary to provide significant utility to rotary can opener mechanism 31.

Referring to FIG. 12, new components will be discussed beginning at the upper left side. An upper handle oval or flattened ball section 205 is seen positioned over a similar shaped lower handle flattened ball section 207. The lower handle ball section fits onto a rotation stem 209 having an aperture 211 at its upper end to intermit with a lower handle ball threaded member 213. The lower end of the rotation stem 209 is attached to a crank upper section 215. Crank upper section 215 has an attachment to a crank lower section 217. The crank lower section includes a pair of spaced apart pivot fittings 219 each having a pivot aperture 221. At the inside of the pair of spaced apart pivot fittings 219, a detent engagement surface 223 is seen. A detent engagement surface 223 is configured to provide a detent resting space for the crank upper and lower sections 215 and 217 in a storage position aligning with the upper housing section 241, and also in a second unfolded position when in use. The upper handle flattened ball section 205, lower handle flattened ball section 207, rotation stem 209, crank upper section 215, crank lower section 217, and pair of spaced apart pivot fittings 219 may be referred to as a crank assembly 224.

Adjacent the crank lower section 217 is a rotation and pivot fitting 225 that provides a rotational crank action for operation of the can opener 201, and a pivot action for the crank lower section 217. The pivot fitting 225 has a central main wide slot 227 for accepting the pair of spaced apart pivot fittings 219. A ball filler fitting 229 will occupy a part of the central main wide slot 227 between the a pair of spaced apart pivot fittings 219 in order to make a smooth appearance, and to cover the pivot fitting mechanical components. Ball filler fitting 229 has a pair of detents 230 that engage detent engagement surface 223 to help hold the crank assembly 224 in place in the closed open position, as well as a central detent 230B which help hold the crank assembly 224 in place in the closed, stowed position. A crank pivot pin 231 is seen in a position of parallel alignment with a multi bore opening 233, as well as a pair spaced apart lateral pin apertures 235 seen in the pivot fitting 225. The crank pivot pin fits through the pair spaced apart lateral pin apertures 235, the pivot apertures 221 of the pair of spaced apart pivot fittings 219, the multi bore opening 233, and the engagement aperture 35 of the drive shaft 33 when the upper end of drive shaft 33 is inserted within the engagement aperture 35 ball filler fitting 229. Also shown are a pair of finishing caps 237 that are sized to fit into matching spaces and over the exposed ends of the pair spaced apart lateral pin apertures 235 to give the can opener 201 a more finished appearance.

An upper housing section 241 having a handle portion 243 and gear housing portion 245 overlies in matching exploded alignment with a lower housing section 251 having a handle portion 253 and gear housing portion 255. The upper housing section 241 has a number of features and structures that enable it to mate with, join, and be secured to the lower housing section 251. A series of joining fasteners are seen, with three gear housing portion fasteners 261 seen over the gear housing portion 245 and two handle housing portion fasteners 263 shown below the handle housing portion 253. A pair of finishing caps 265 are seen to be associated with the two handle housing portion fasteners 263 to cosmetically cover countersunk bores into which the fasteners 263 fit.

An upper housing section 241 has a number of visible features including an upper engagement gear aperture 271 through that the upper engagement gear 41 will protrude to be engaged by the rotation and pivot fitting 225. Distributed about the upper engagement gear aperture 271 is a series of threaded member engagement apertures 275. The handle portions 243 and 253 have a through opening 277 for accommodating the upper handle flattened ball section 205. The handle portions 243 and 253 also have a hanger opening 279 to enable a hanging or lanyard-type storage of the can opener 201. Lower housing section 251 has a number of visible features including an countersunk aperture bores 281 to accommodate the two handle housing portion fasteners 263. Within the gear housing portion 255 of the Lower housing section 251 a series of three raised threaded bore fastener supports 285 are seen for providing engagement and material support for the fasteners 261. Also seen are the previously identified cutter movement gear boss 131 and drive gear boss 55. Although not directly seen, the gear housing portion 255 of the lower housing section 251 forms the housing section 51 that was shown in FIGS. 1-4. Other previously seen components of the can opener 201 are predominantly visible in FIG. 12 but not discussed.

Figure 13:
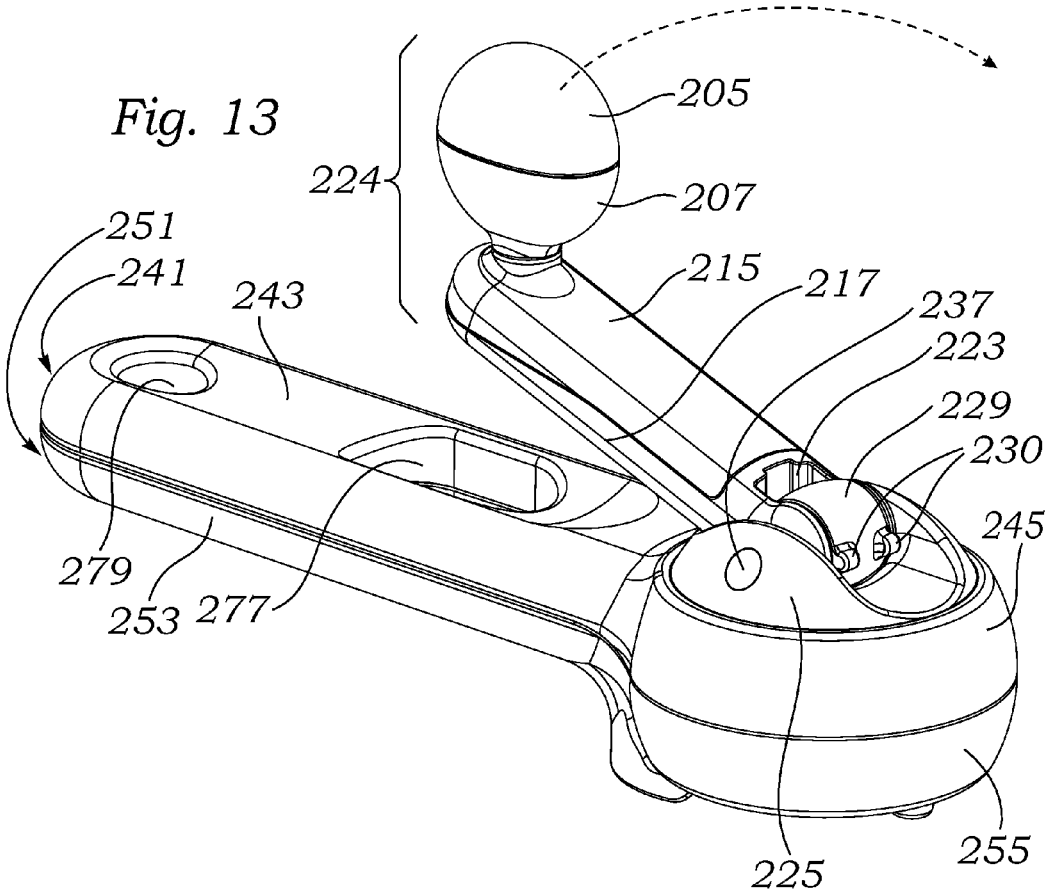
FIG. 13 illustrates a perspective view similar to the exploded view of FIG. 12 and seen with the assembled components of the can opener the same orientation as in FIG. 12.

Referring to FIG. 13, a perspective view similar to the exploded view of FIG. 12 is seen with the assembled components of the can opener 201 in roughly the same orientation as they were seen in FIG. 12. The configuration seen in FIG. 13 is in a position where the upper and lower handle ball sections 205 and 207 are ready to be turned to cause rotation and pivot fitting 225 to turn while rotation and pivot fitting 225 engages and causes upper engagement gear 41 to turn to operate the mechanism as shown. Turning in one direction causes the rotary can opener mechanism 31 to close and turning in the other direction causes the rotary can opener mechanism 31 to open.

Figure 14:
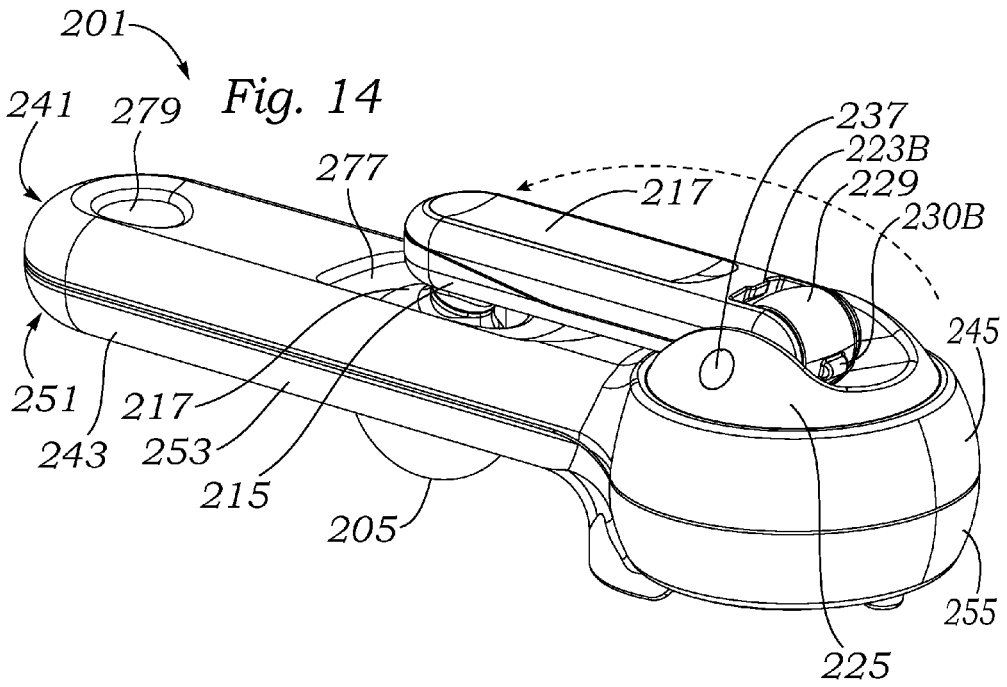
FIG. 14 illustrates a perspective view of the can opener showing the upper handle flattened ball section protruding through the through an opening such that the crank assembly is in lock down position.
Figure 15:
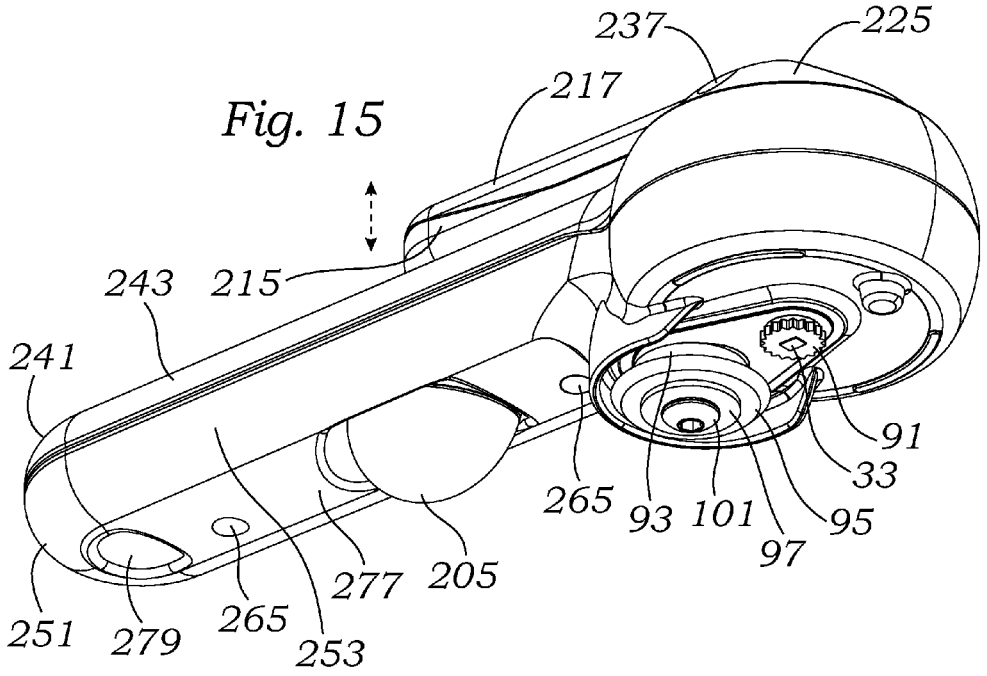
FIG. 15 is a perspective view of the can opener as was seen in FIG. 14 and shown from an upwardly directed perspective position.

Referring to FIG. 14, a perspective view of the can opener 201 shows the upper handle flattened ball section 205 protruding through the through opening 277 such that the crank assembly 224 is in lock down position. Referring to FIG. 15, a perspective view of the can opener 201 as was seen in FIG. 14 is shown from an upper perspective position.

Figure 16:
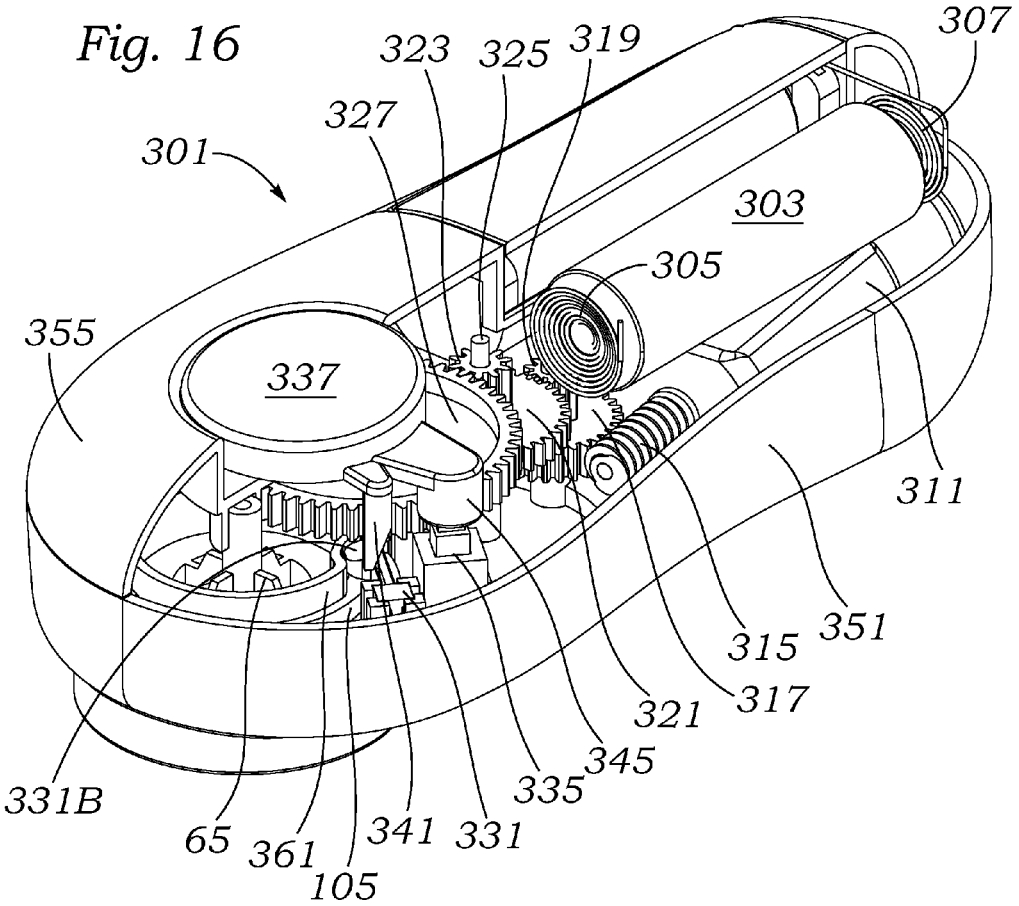
FIG. 16, is a perspective cut-away view of an electrically driven opener.

Referring to FIG. 16, a perspective cut-away view of an electrically driven opener 301 shows a battery 303, contacts 305 and 307, and an electric motor 311 switchably powered by the battery 303. Electric motor 311 is connected through a series of speed reduction gears including a worm gear 315 connected to the motor 311, a first reduction gear 317, first reduction gear pinion 319 with the first reduction gear 317 about an axle (not seen in FIG. 16), and engaging a second reduction gear 321. A second reduction gear pinion 323 turning with the second reduction gear 321 about an axle 325, engages a drive gear 327. Although not seen directly, the drive gear 327 engages the upper engagement gear 41, and operates the rotary can opener mechanism 31 in the same way as was described for FIGS. 1-11. The only difference noted is that the cutter gear 65 is located forward of the axial drive gear set 37 that is directly driven by the drive gear 327.

A momentary action switch 331 may be located next to a polarity reversing switch 335. A cam follower 331B attached to the momentary switch 331 is shown resting against a cam surface 361 which extends from upper flattened rim 105. A button 337 acts in concert with its mechanically connected actuators 341 and 345 to simultaneously actuate both the momentary action switch 331 and polarity reversing switch 335 simultaneously upon the pressing of the button 337. The circuitry connecting the above switches can be many and varied, and involve mechanical switches as well as electronic switches. One embodiment will be shown and explained with respect to FIG. 17. Meanwhile it can be seen the electric battery powered can opener 301 has a base housing 351 and an upper housing 355.

Figure 17:
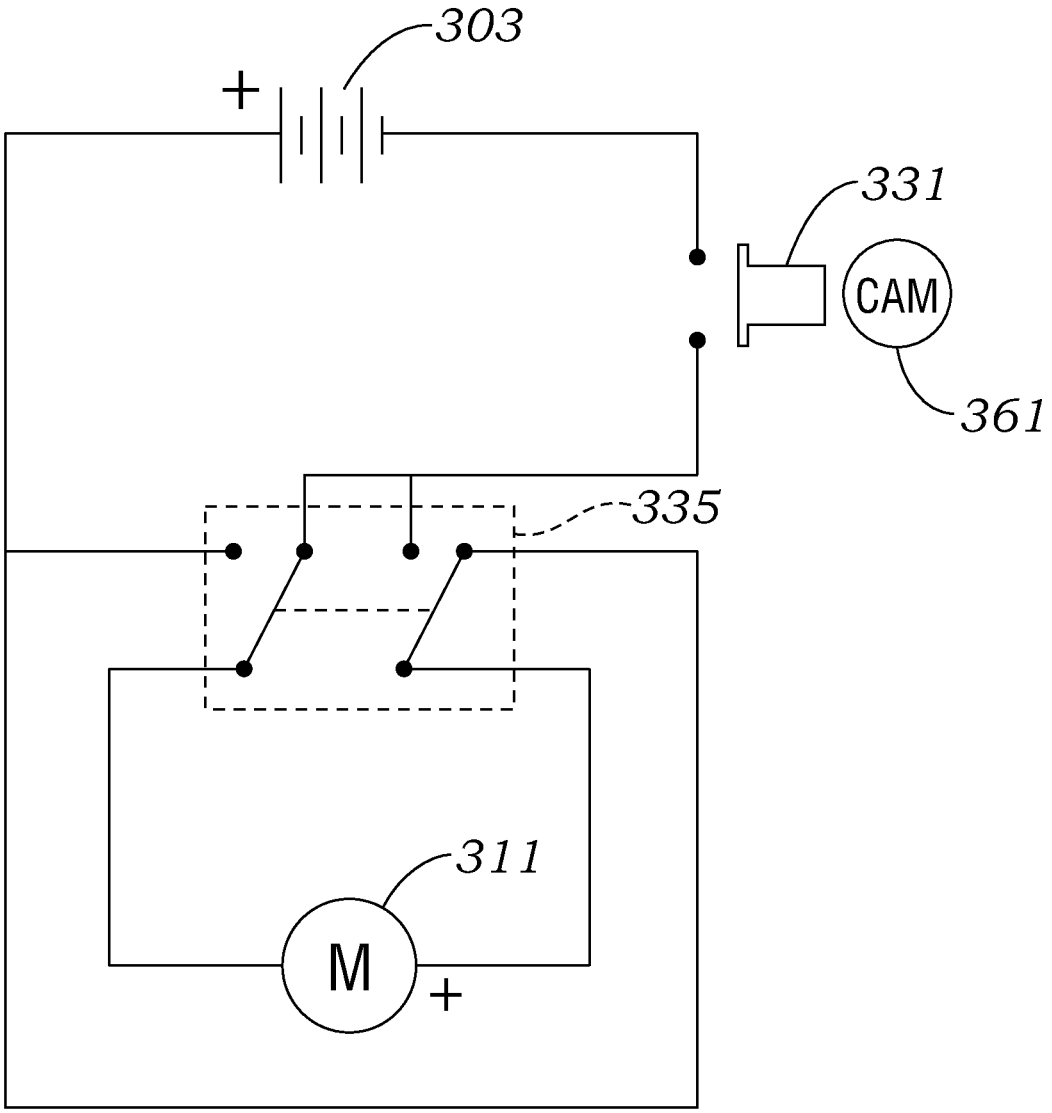
FIG. 17 is one possible realization of circuitry possibly usable with the can opener shown in FIG. 16.

Referring to FIG. 17, a schematic electrical diagram is shown where momentary action switch 331 is seen as well as polarity reversing switch 335. From a state in which the motor 311 is off, a cam structure 361 enables a cutting off of momentary action switch 331. Pressing the button 337 changes the reverse switch 335 to the opposite position to allow the positive side of the battery 303 to electrically connect to the "+" side of the polarity reversing switch 335, and to start the motor 311 toward the closure and can opening position. Once the motor 311 has operated for a second or two, the cam 361 holds the momentary action switch 331 in the closed position and the momentary action switch 331 no longer needs to be pressed throughout the cycle. The motor causes the can opener 301 to close about a can 85 and for the opening cycle to continue cutting a can 85 upper rim 83 from a can. As the mechanism achieves the state seen in FIGS. 9 and 10. The can continues to be processed until the user again presses the button 337 to reverse the mechanism. This moves the polarity reversing switch 335 to the position opposite that seen in FIG. 17, where positive current flows to the non positive side of the motor 311 to cause the motor to reverse itself and begin to open the can opener 301. This opening process continues normally until the upper rim 83 is released and in any event until the rotary can opener mechanism 31 is stopped. The opening process continues until the state seen in FIG. 5 is achieved. In this state, due to CAM 361, the break in the circuit of FIG. 17 causes the motor 311 to stop. The can opener 301 is now open and waiting for another can opening cycle.

While the preferred embodiments of the invention have been shown and described, it will be understood by those skilled in the art that changes of modifications may be made thereto without departing from the true spirit and scope of the invention.

We claim:

1. A can opener comprising:

a motor contained within the housing and mechanically operably connected to a lower drive gear;

a switch, connectable to a source of electrical power and having a connection to the motor;

a housing having a cutter movement gear boss having an internal bore and an external diameter;

a cutter movement gear having a central cylindrical member supported within the bore of the cutter movement gear boss, and a shortened arc series of radial gear teeth terminating at a pair of missing teeth portions at each end of the shortened arc series of radial gear teeth, a downwardly extending overhang member between the pair of missing teeth portions on an opposite side of the cutter movement gear with respect to the shortened arc series of radial gear teeth, the downwardly extending overhang member having an interior portion side from which an interference bump projects radially inwardly; and an idle gear having an upper toothed portion and a cylindrical lower portion and an internal surface larger than an external cylindrical surface of the cutter movement gear boss;

the lower drive gear having teeth that simultaneously engage the toothed upper portion of the idle gear and at least one of the missing teeth portions on the opposite sides of the cutter movement gear and the series of radial gear teeth of the cutter movement gear, the lower drive gear acting to engage the toothed upper portion of the idle gear compressively in a manner to allow the idle gear to move laterally taken with respect to a distance between the cutter movement gear and the lower drive gear to thereby engage the interference bump whereby rotational force is transmitted from the idle gear to the cutter movement gear to move the cutter movement gear to engage the series of gear teeth of the cutter movement gear with the teeth of the lower drive gear upon rotation of the motor, and where the lower drive gear is operatively connected to the motor through a series of speed reduction gears.

2. The can opener as recited in claim 1 wherein the cutter movement gear boss has a projection in a direction of the lower drive gear.

3. The can opener as recited in claim 2 wherein the projection is an ellipse shaped structure.

4. The can opener as recited in claim 2 wherein the projection is a rib.

5. A can opener comprising:

a motor contained within the housing and mechanically operably connected to a lower drive gear;

a switch, connectable to a source of electrical power and having a connection to the motor;

a housing having a cutter movement gear boss having an internal bore and an external diameter;

a cutter movement gear having a central cylindrical member supported within the bore of the cutter movement gear boss, and a shortened arc series of radial gear teeth terminating at a pair of missing teeth portions at each end of the shortened arc series of radial gear teeth, a downwardly extending overhang member between the pair of missing teeth portions on an opposite side of the cutter movement gear with respect to the shortened arc series of radial gear teeth, the downwardly extending overhang member having an interior portion side from which an interference bump projects radially inwardly; and an idle gear having an upper toothed portion and a cylindrical lower portion and an internal surface larger than an external cylindrical surface of the cutter movement gear boss;

the lower drive gear having teeth that simultaneously engage the toothed upper portion of the idle gear and at least one of the missing teeth portions on the opposite sides of the cutter movement gear and the series of radial gear teeth of the cutter movement gear, the lower drive gear acting to engage the toothed upper portion of the idle gear compressively in a manner to allow the idle gear to move laterally taken with respect to a distance between the cutter movement gear and the lower drive gear to thereby engage the interference bump whereby rotational force is transmitted from the idle gear to the cutter movement gear to move the cutter movement gear to engage the series of gear teeth of the cutter movement gear with the teeth of the lower drive gear upon rotation of the motor, and wherein the lower drive gear includes a worm gear connected to an output shaft of the motor to define the mechanical operable connection.

6. A can opener comprising:

a motor contained within the housing and mechanically operably connected to a lower drive gear;

a switch, connectable to a source of electrical power and having a connection to the motor;

a housing having a cutter movement gear boss having an internal bore and an external diameter;

a cutter movement gear having a central cylindrical member supported within the bore of the cutter movement gear boss, and a shortened arc series of radial gear teeth terminating at a pair of missing teeth portions at each end of the shortened arc series of radial gear teeth, a downwardly extending overhang member between the pair of missing teeth portions on an opposite side of the cutter movement gear with respect to the shortened arc series of radial gear teeth, the downwardly extending overhang member having an interior portion side from which an interference bump projects radially inwardly; and an idle gear having an upper toothed portion and a cylindrical lower portion and an internal surface larger than an external cylindrical surface of the cutter movement gear boss;

the lower drive gear having teeth that simultaneously engage the toothed upper portion of the idle gear and at least one of the missing teeth portions on the opposite sides of the cutter movement gear and the series of radial gear teeth of the cutter movement gear, the lower drive gear acting to engage the toothed upper portion of the idle gear compressively in a manner to allow the idle gear to move laterally taken with respect to a distance between the cutter movement gear and the lower drive gear to thereby engage the interference bump whereby rotational force is transmitted from the idle gear to the cutter movement gear to move the cutter movement gear to engage the series of gear teeth of the cutter movement gear with the teeth of the lower drive gear upon rotation of the motor, a drive wheel rotationally engaged with the lower drive gear for engaging an upper rim of a can to be cut; and a cutter supported and moveable with the cutter movement gear, the cutter movement gear causing the cutter to move toward and away from the drive wheel.

7. A can opener as recited in claim 6 wherein the drive wheel has a diameter of about one centimeter.

* * * * *